US008072300B2

(12) United States Patent
Sako et al.

(10) Patent No.: US 8,072,300 B2
(45) Date of Patent: Dec. 6, 2011

(54) ELECTROMAGNETIC RELAY

(75) Inventors: Kazumi Sako, Kyoto (JP); Hideki Kuboyama, Kyoto (JP); Toshiyuki Furukawa, Kyoto (JP); Tatsuhiro Yasutake, Kyoto (JP); Takeo Okuda, Kyoto (JP)

(73) Assignee: OMRON Corporation, Kyoto (JP)

( * ) Notice: Subject to any disclaimer, the term of this patent is extended or adjusted under 35 U.S.C. 154(b) by 138 days.

(21) Appl. No.: 12/597,082

(22) PCT Filed: Apr. 17, 2008

(86) PCT No.: PCT/JP2008/057499

§ 371 (c)(1),
(2), (4) Date: Oct. 22, 2009

(87) PCT Pub. No.: WO2008/133174

PCT Pub. Date: Nov. 6, 2008

(65) Prior Publication Data

US 2010/0117771 A1 May 13, 2010

(30) Foreign Application Priority Data

Apr. 25, 2007 (JP) ..... 2007-115831

(51) Int. Cl.
*H01H 51/22* (2006.01)

(52) U.S. Cl. ..... 335/80; 335/78

(58) Field of Classification Search ..... 335/78–86
See application file for complete search history.

(56) References Cited

U.S. PATENT DOCUMENTS 5,015,978 A * 5/1991 Yokoo et al. ..... 335/78
5,309,623 A * 5/1994 Okamoto et al. ..... 29/602.1
5,617,066 A * 4/1997 Dittmann et al. ..... 335/78

FOREIGN PATENT DOCUMENTS

JP 61-218025 A 9/1986
JP 9-259726 A 10/1997
JP 9-288954 A 11/1997

OTHER PUBLICATIONS

International Search Report issued in PCT/JP2008/057499, mailed on Jul. 1, 2008, with translation, 2 pages.
International Preliminary Report on Patentability with Written Opinion issued in PCT/JP2008/057499 dated Nov. 19, 2009. (7 pages).
Partial Translation of JP 61-218025 A (6 pages).

* cited by examiner

*Primary Examiner* — Ramon Barrera
(74) *Attorney, Agent, or Firm* — Osha • Liang LLP

(57) ABSTRACT

An electromagnetic relay has a movable block, hinge portions protruding from both sides of the movable block on an axis, having a wide connection portion and a shaft portion, a base block having common contact terminals disposed thereon, and an electromagnetic block mounted on the base block. The connection portions are welded to be integrated with the common contact terminals to provide welded portions. Based on excitation and non-excitation of the electromagnetic block, the movable block rotates, with the shaft portions as a rotation axis to open and close contacts. The welded portion is provided in an inside edge portion of the connection portion. A reference line connects a point of action located between the welded portion and the rotation axis, and a center of the welded portion. The reference line intersects a boundary between the connection portion and the welded portion, which are welded so as to be integrated.

4 Claims, 9 Drawing Sheets

(A)

(B)

(A)

(B)

ELECTROMAGNETIC RELAY

TECHNICAL FIELD

The present invention relates to an electromagnetic relay, in particular to an attachment structure of its movable block.

BACKGROUND ART

In the past, for example, there has been an electromagnetic relay in which, of a pair of hinge portions protruded from both sides of a movable block on a same axis, wide connection portions are welded so as to be integrated with common contact terminals of a base block to provide welded portions, and based on excitation and non-excitation of an electromagnetic block mounted on the base block, the movable block is rotated, with shaft portions of the hinge portions as a rotation axis to open and close contacts (refer to Patent Document 1).

Patent Document 1: JP61-218025A

DISCLOSURE OF INVENTION

However, in the above electromagnetic relay, the connection portions forming the hinge portions are merely connected so as to be integrated with the common contact terminals. Therefore, if the movable block is rotated based on excitation and non-excitation of the electromagnetic block, a stress whose point of action is at a basal portion of a shaft portion, which forms a hinge portion, is concentrated at end portions of a boundary between a connection portion and a welded portion, so that cracks are liable to occur at the hinge portion.

One or more embodiments of the present invention provides an electromagnetic relay in which cracks hardly occur and which has a much longer life.

In an electromagnetic relay according to one or more embodiments of the present invention, of a pair of hinge portions protruded from both sides of a movable block on a same axis, wide connection portions are welded so as to be integrated with common contact terminals of a base block to provide welded portions, and based on excitation and non-excitation of an electromagnetic block mounted on the base block, the movable block is rotated, with shaft portions of the hinge portions as the rotation axis to open and close contacts, a reference line connecting a point of action, which is located between a welded portion provided in an inside edge portion of a connection portion of a hinge portion and the rotation axis, and a center of a welded portion intersects a boundary between the connection portion and the welded portion, which are welded so as to be integrated.

According to one or more embodiments of the present invention, since an internal stress generated from the point of action, which is located at the basal portion of the shaft portion forming the hinge portion, dispersedly acts on the boundary between the connection portion and the welded portion, a stress concentration does not occur. Therefore, cracks hardly occur, and an electromagnetic relay having a much longer life is obtained.

In an embodiment of the present invention, a bottom portion of a cutout portion provided in the inside edge portion of the connection portion of the hinge portion is welded so as to be integrated with a common contact terminal of the base block to provide the welded portion.

According to the present embodiment, the boundary between the connection portion and the welded portion becomes longer, so that a retention force obtained by welding is improved, and an electromagnetic relay having a much longer life is obtained.

In an embodiment of the present invention, the hinge portion may have a roughly T-shape in plan view or a roughly L-shape in plan view.

According to the present embodiment, the hinge shape can be selected as necessary, and there is an effect that a versatile electromagnetic relay is obtained.

DESCRIPTION OF NUMERALS

Figure 1:
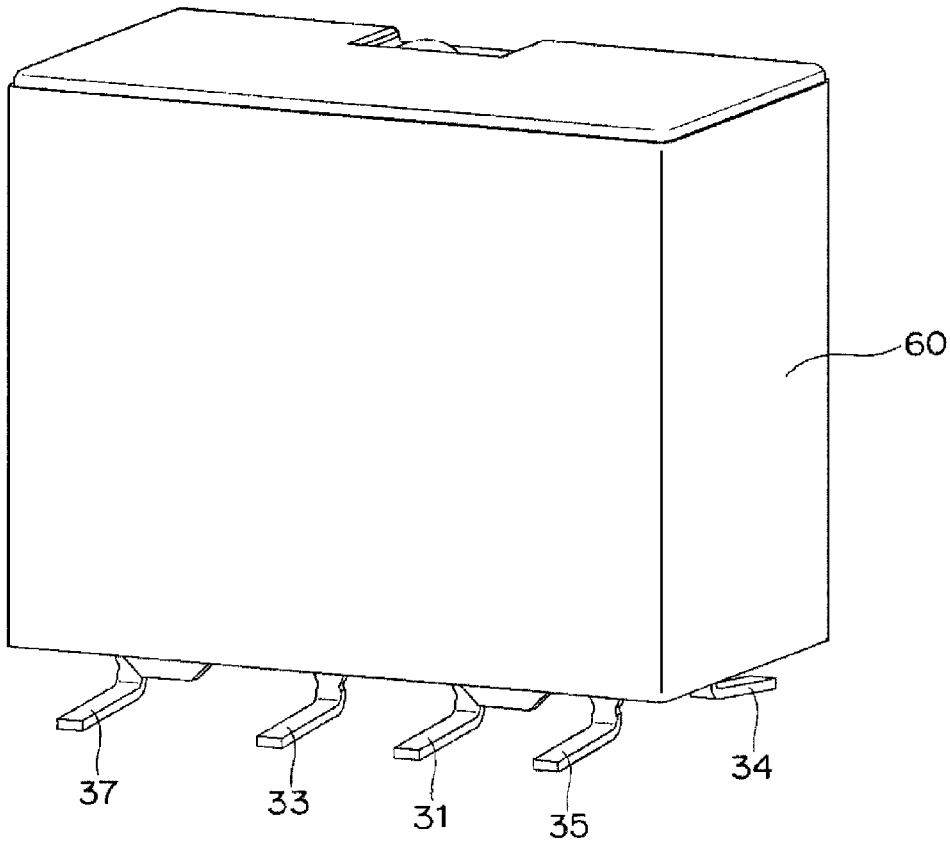
FIG. 1 is a perspective view of an electromagnetic relay according to one or more embodiments of the present invention.
Figure 2:
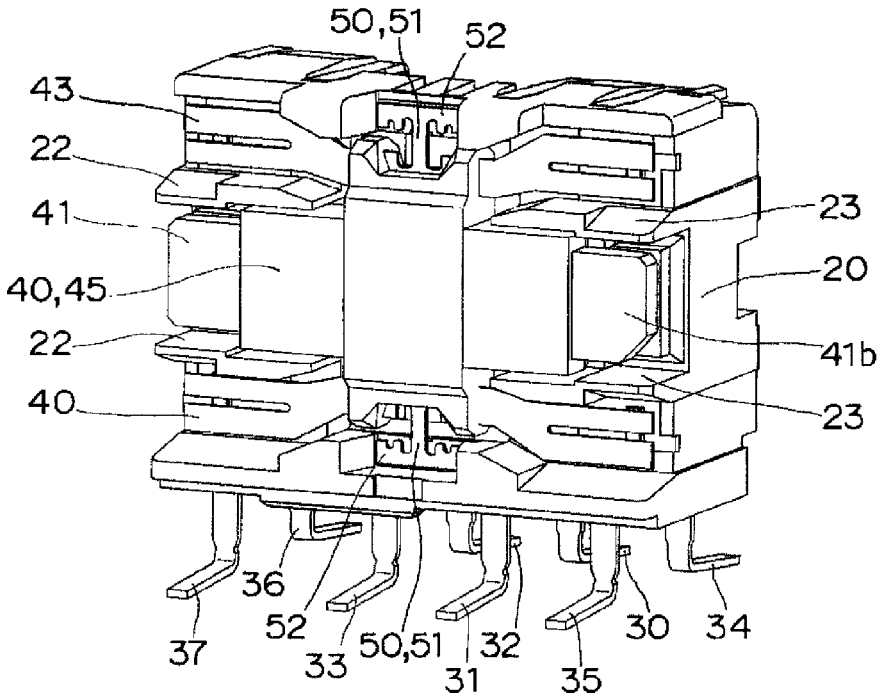
FIG. 2A and FIG. 2B are perspective views of the electromagnetic relay in which a case cover has been removed, which are seen at different angles.
Figure 2:
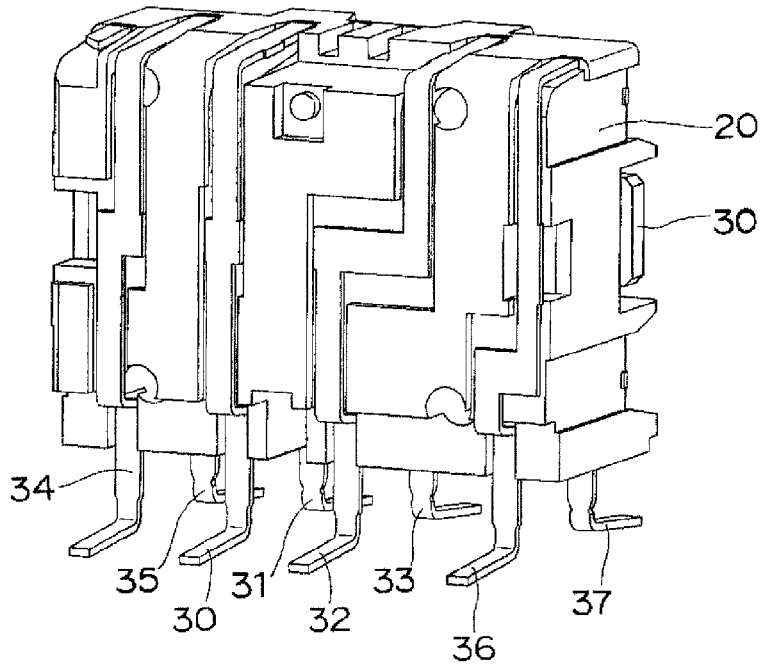

10: electromagnetic block
11: spool
14: iron core
14*a*, 14*b*: magnetic pole portion
15: coil
20: base block
21, 21: protrusion
22, 23: insulating wall
30, 31: common contact terminal
30*a*, 31*a*: connection receiving portion
32, 33, 34, 35: fixed contact terminal
36, 37: coil terminal
40: movable block
41: movable iron piece
42: permanent magnet
43, 44: movable contact piece
45: movable block body
50: hinge portion
51: shaft portion
52: connection portion
53: first cutout portion
54: second cutout portion
55: third cutout portion

57: reference line
58: point of action
59: welded portion
60: case cover

BEST MODE FOR CARRYING OUT THE INVENTION

In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

An embodiment of the present invention will be described with reference to the attached drawings of FIGS. 1 to 10.

An electromagnetic relay of the present embodiment consists of a base block 20 in which an electromagnetic block 10 is insert-molded, a movable block 40, and a case 60 as shown in FIGS. 1 to 8.

Figure 5:
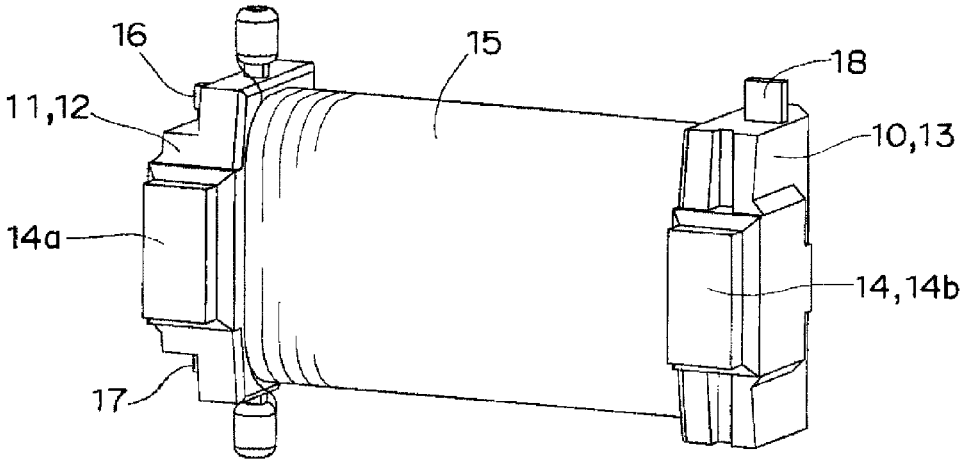
FIG. 5A and FIG. 5B are perspective views of the electromagnetic relay.
Figure 5:
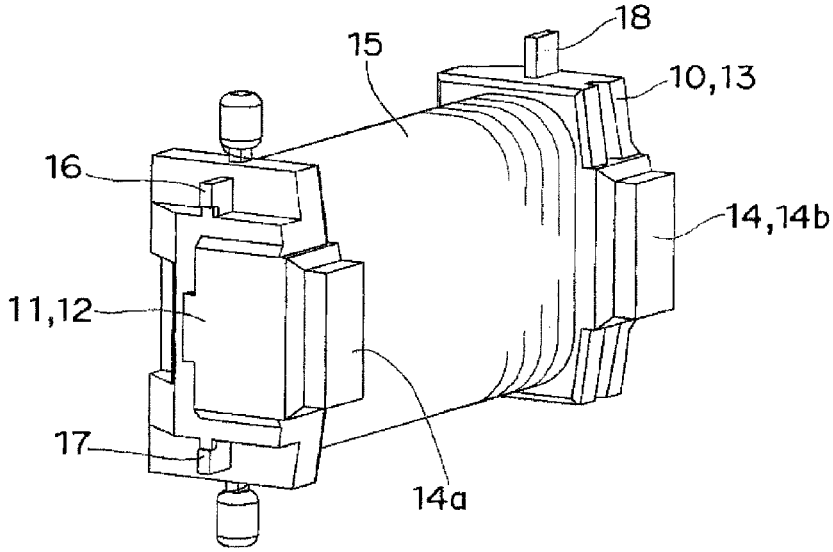
Figure 6:
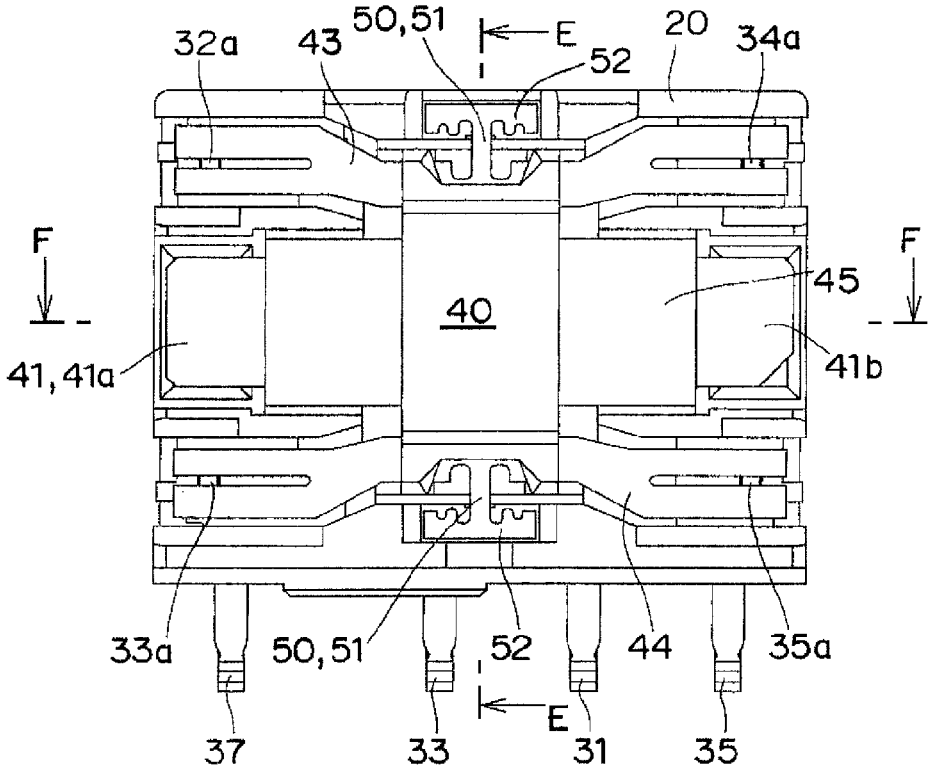
FIG. 6 is an elevational view when the case cover of the electromagnetic relay shown in FIG. 1 has been removed.

As shown in FIG. 5, the electromagnetic block 10 is obtained by insert-molding an iron core 14 having a C-shape in cross section in a spool 11 having flange portions 12, 13 at its both ends, and winding a coil 15 around the spool 11. Lead wires of the coil 15 are tied and soldered to relay terminals 16, 17 insert-molded in the flange portion 12 of the spool 11, and coil terminals 36, 37 described below are connected to the relay terminals 16, 17, respectively. In addition, a supporting terminal 18 for connecting and supporting a lead frame (not shown) during insert molding is insert-molded in the flange portion 13 of the spool 11.

Figure 3:
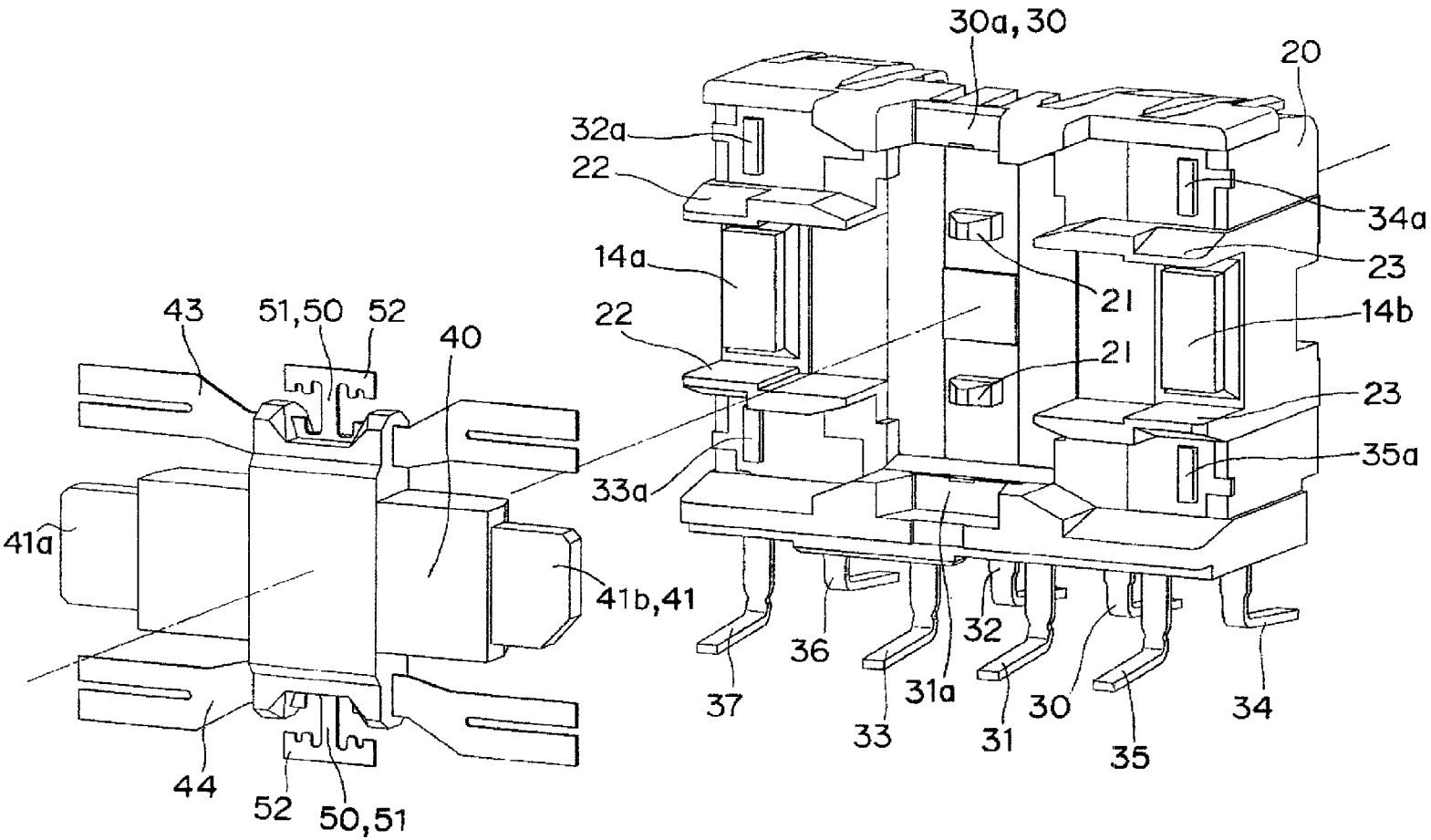
FIG. 3 is an exploded perspective view of the perspective view shown in FIG. 2A.
Figure 4:
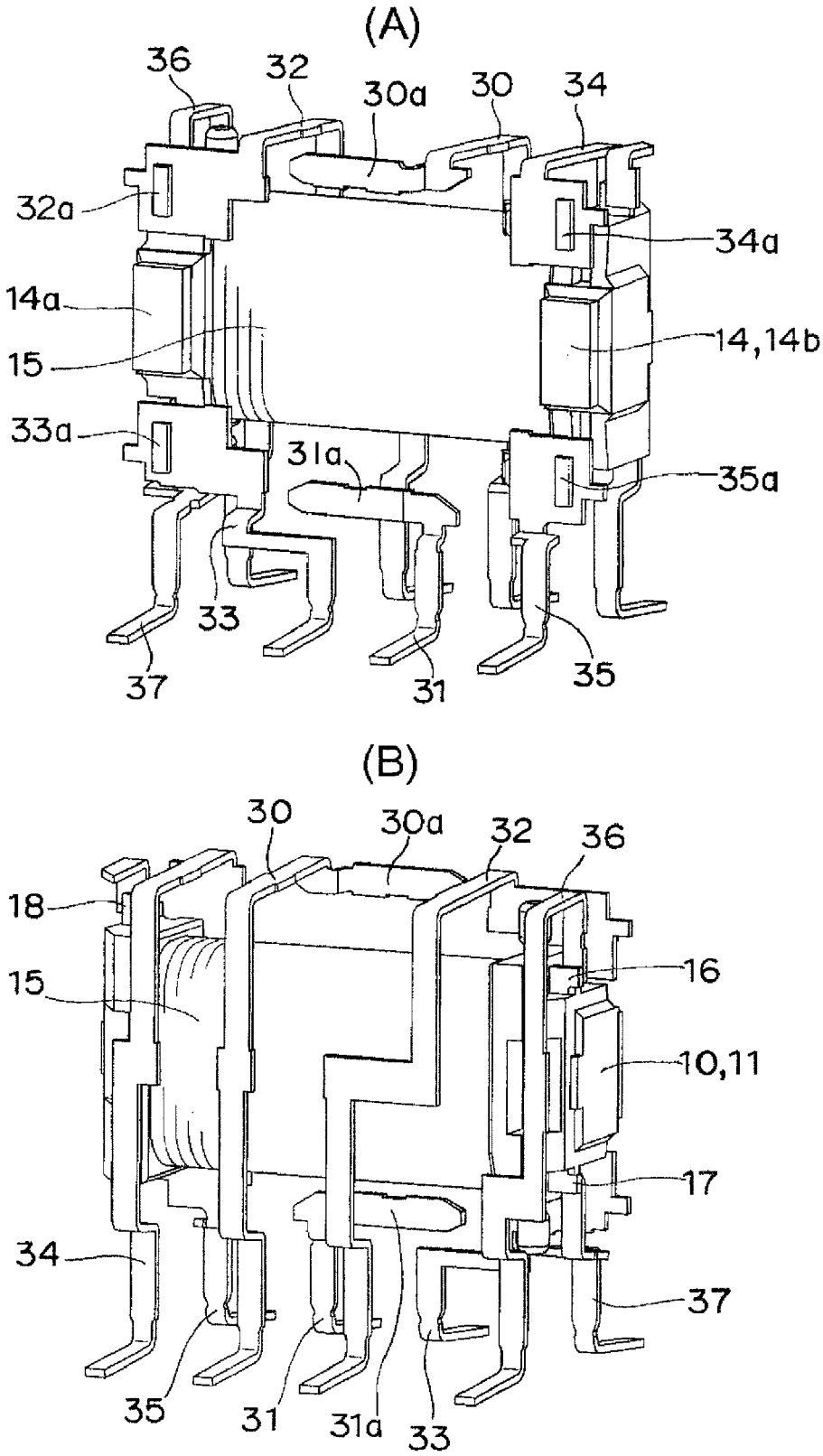
FIG. 4A and FIG. 4B are perspective views showing when a base block has been removed from FIG. 2A and FIG. 2B, respectively.

The base block 20 is manufactured by insert molding the electromagnetic block 10 connected to the lead frame not shown in the base block 20, followed by press working. As shown in FIG. 3, in the base block 20, a pair of protrusions 21, 21 serving as rotation fulcra are protrusively provided at the roughly center of its front, namely at the roughly center between magnetic pole portions 14*a*, 14*b* of the iron core 14. Further, connection receiving portions 30*a*, 30*b* of common contact terminals 30, 31 are exposed collinearly with the protrusions 21, 21. On both sides of the magnetic pole portion 14*a*, fixed contact terminals 32, 33 provided with fixed contacts 32*a*, 33*a* are exposed. On the other hand, on both sides of the magnetic pole portion 14*b*, fixed contact terminals 34, 35 provided with fixed contacts 34*a*, 35*a* are exposed. The common contact terminal 30, the fixed contact terminals 32, 34 and the coil terminal 36, which are located on an upper side, are detoured to a back surface side of the base block 20, and protruded downward from a bottom surface thereof. On the other hand, the common contact terminal 31, the fixed contact terminals 33, 35, and the coil terminal 37, which are located on a lower side, are protruded downward from the bottom surface of the base block 20. The magnetic pole portion 14*a* and the fixed contacts 32*a*, 33*a* are partitioned by insulating walls 22, 22. In addition, the magnetic pole portion 14*b* and the fixed contacts 34*a*, 35*a* are partitioned by insulating walls 23, 23.

Figure 7:
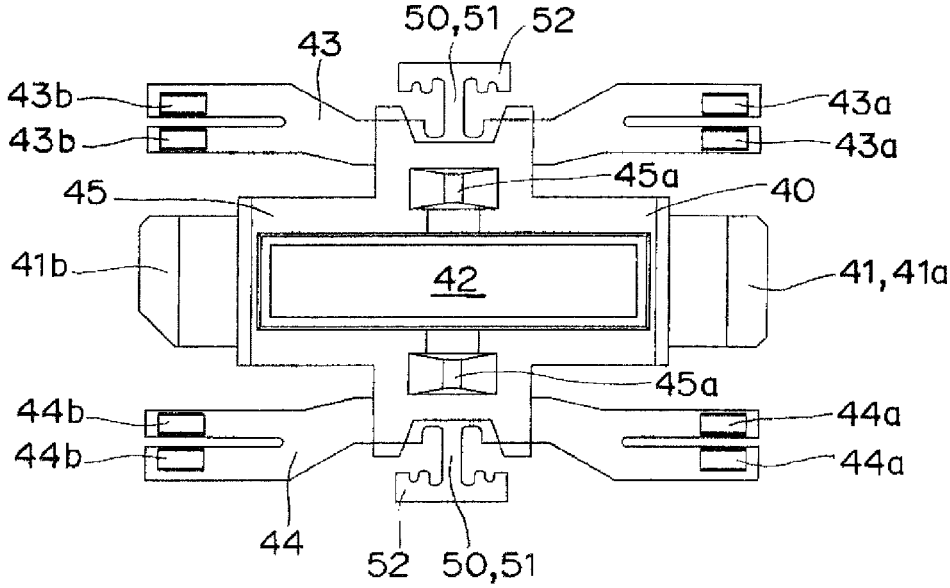
FIG. 7 is a rear view of a movable block shown in FIG. 3.
Figure 8:
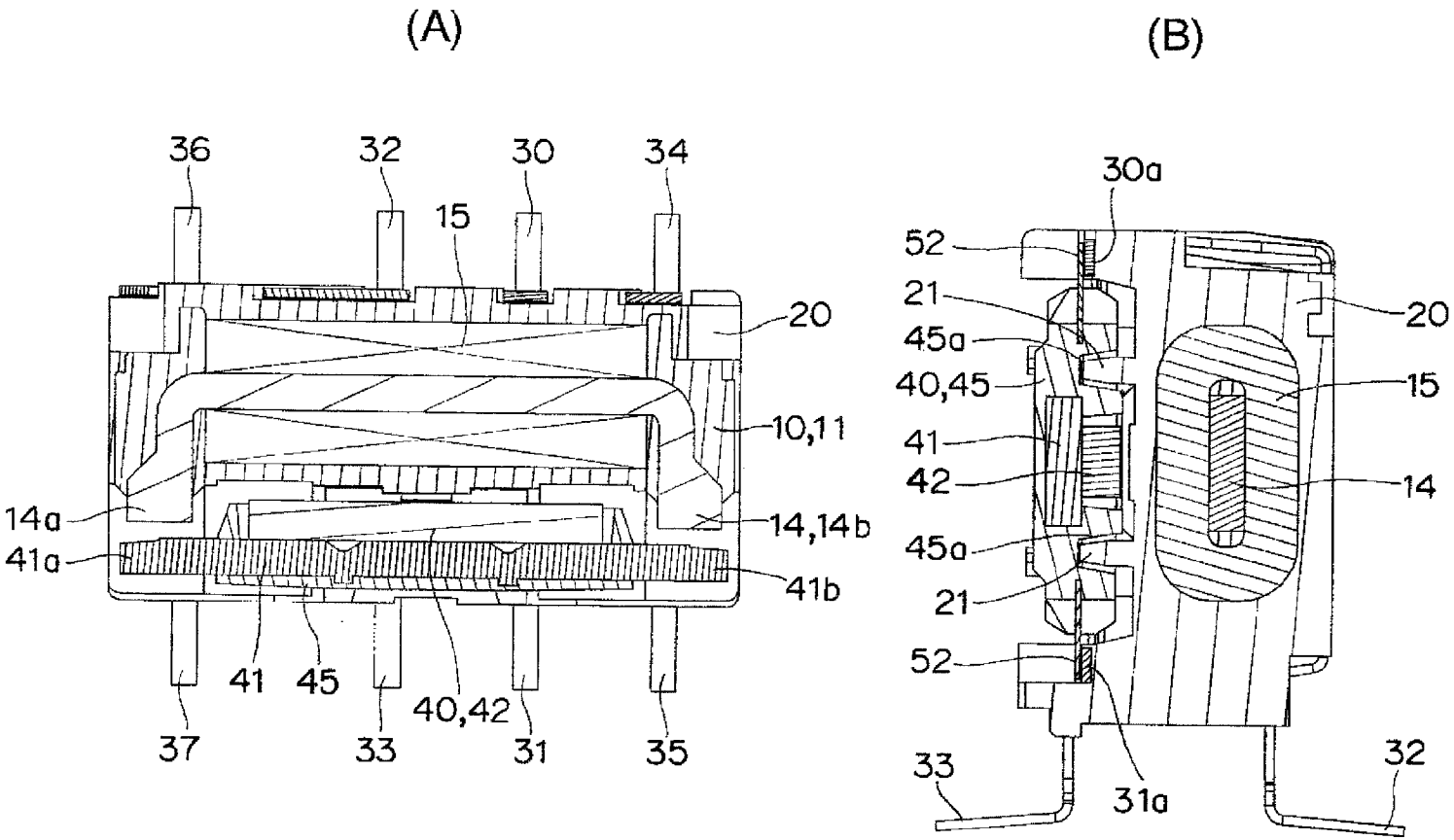
FIG. 8A and FIG. 8B are cross sectional views taken along line F-F and line E-E, respectively, which are shown in FIG. 6.

In the electromagnetic block 40, as shown in FIGS. 3 and 7, a plate-shaped permanent magnet 42 is attached to a back surface side of a strip-shaped movable iron piece 41, and movable contact pieces 43, 44 are disposed parallel to each other on both sides of the strip-shaped movable iron piece 41, and also the movable iron piece 41, the movable permanent magnet 42, and the movable contact pieces 43, 44 are formed integrally with a movable block body 45.

The movable iron piece 41 is covered by the movable block body 45 excluding both-side end portions 41*a*, 41*b*, and by cutting a corner portion of the one end portion 41*b*, the assembling direction is indicated.

Figure 9:
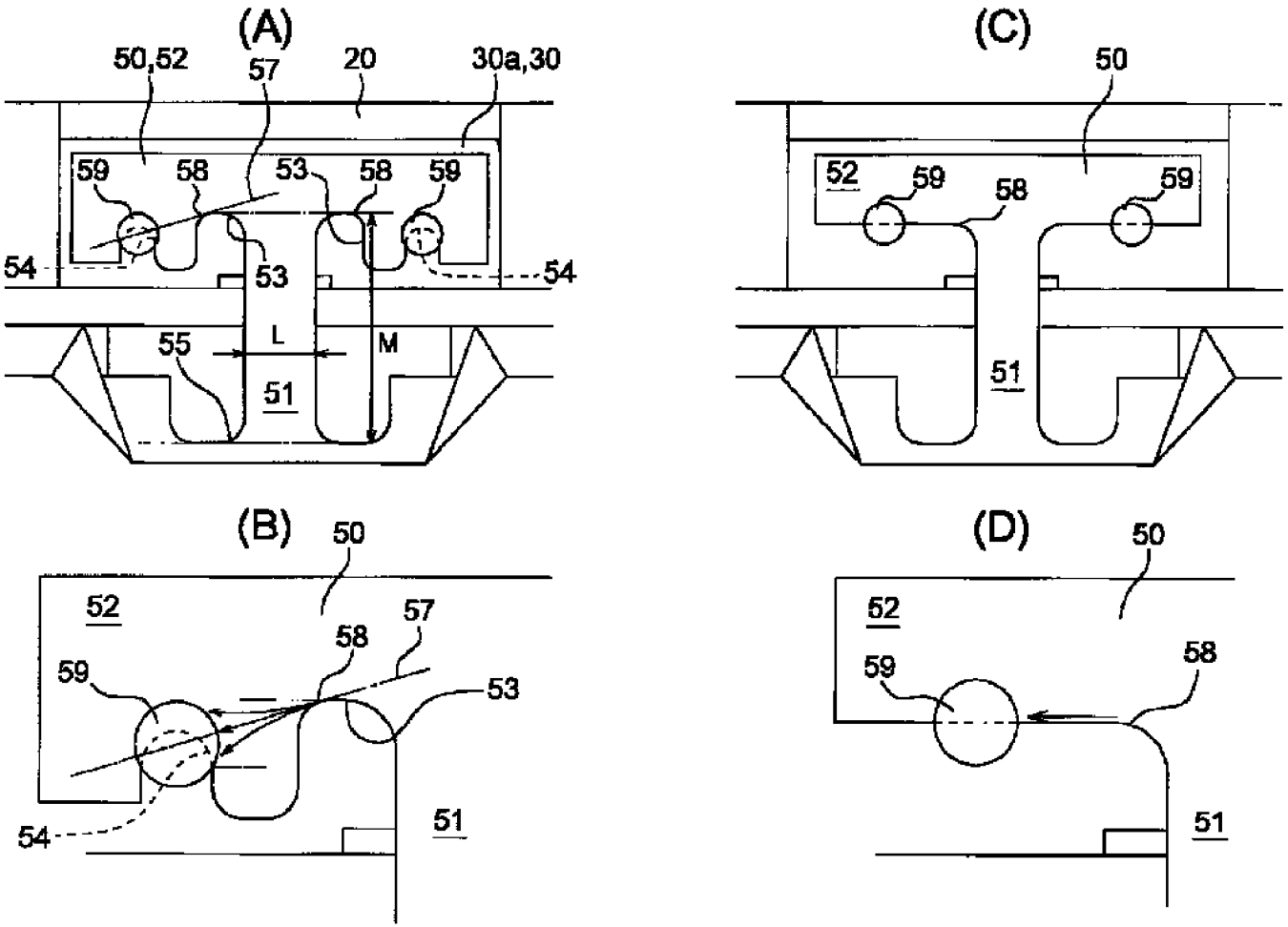
FIG. 9A and FIG. 9B are partially enlarged views showing an Example.
FIG. 9C and FIG. 9D are partially enlarged views showing a Comparative Example.
Figure 10:
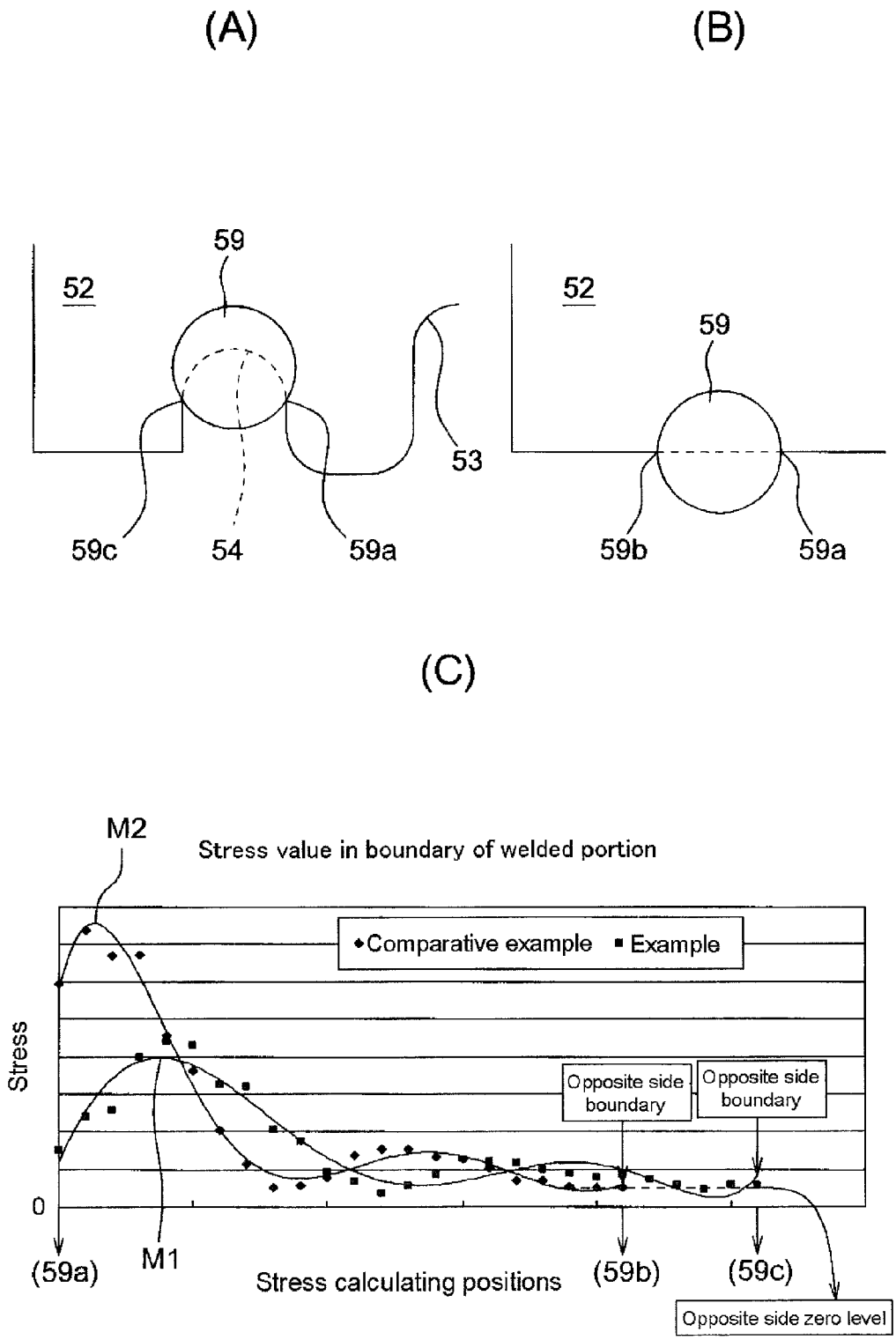
FIG. 10A and FIG. 10B are partially enlarged views of the Example and the Comparative Example, respectively.
FIG. 10C is a graph showing the analysis results.

Both-side end portions of the movable contact piece 43, which are bifurcated in a width direction, are provided with movable contacts 43*a*, 43*b* to provide a twin-contact structure, whereby contact reliability is improved. Further, a roughly T-shaped hinge portion 50 is coplanarly extended from a central portion of one side of the movable contact piece 43*a*. As shown in FIG. 3, the hinge portion 50 is formed of a wide contact portion 52 extended to both right and left sides from an end of a shaft portion 51, and, with the shaft portion 51 as the center, an inside edge portion of the connection portion 52 is provided with a first cutout portion 53 and a second cutout portion 54 (FIG. 9). Bottom portions of the first and second cutout portions 53, 54 have a semicircular shape, and a bottom surface of the first cutout portion 53 is formed deeper than a bottom surface of the second cutout portion 54. This is because a stress generated at a point 58 of action is dispersed so as not to cause stress concentration. Similarly, a basal portion of the inside of the shaft portion 51 is also provided with a semicircular-shaped third cutout portion 55 for preventing stress concentration.

The movable contact piece 44 has a shape that is line symmetrical with the movable contact piece 43, and both end portions thereof are provided with movable contacts 44*a*, 44*b*. Regarding the hinge portion 50, its description is omitted by giving the same numerals.

The movable block body 45 covers the movable iron piece 41 excluding the both-end portions 41*a*, 41*b* thereof, and a bottom surface of the movable contact block body 45 is provided with positioning recesses 45*a*, 45*a* fitted to the protrusions 21, 21 of the base block 20.

Then, the positioning recesses 45*a*, 45*a* of the movable block 40 are fitted to the protrusions 21, 21 of the base block 20 so as to be positioned, and the connection portions 52 of the hinge portions 50 are positioned with respect to the contact portions 30*a*, 31*a* of the common contact terminals 30, 31 exposed from the base block 20. Thereafter, the bottom portions of the second cutout portions 54 are irradiated with a laser, and the connection portions 52 and the connection receiving portions 30*a*, 31*a* are welded so as to be integrated to form welded portions, whereby the movable block 40 is rotatably supported around an axis of the shaft portions 51.

Subsequently, the case cover 60 is put on the base block 20, with which the movable block 40 is integrated, and sealed. After sucking and removing an internal gas from a degassing opening in the case cover 60, the degassing opening is thermally sealed, and an assembling work is completed.

Next, an operation of the electromagnetic relay will be described.

When the electromagnetic block 10 is in a non-excited state, one end portion 41*a* of the movable iron piece 41 is attracted to the magnetic pole portion 14*a* of the iron core 14 by a magnetic force of the permanent magnet 42, and the movable contacts 43*a*, 44*a* are in contact with the fixed contacts 32*a*, 33*a*, respectively.

If the coil 15 of the electromagnetic block 10 is excited by applying a voltage so that a magnetic flux is generated in a direction in which the magnetic force of the permanent magnet 42 is canceled, the magnetic pole portion 14*b* of the iron core 14 attracts the other end portion 41*b* of the movable iron piece 41, and the movable block 40 is rotated against the magnetic force of the permanent magnet 42. Therefore, the movable contacts 43*a*, 44*a* are separated from the fixed contacts 32*a*, 33*a*, the movable contacts 43*b*, 44*b* come in contact with the fixed contacts 34*a*, 35*b*, and then the other end portion 41*b* of the movable iron piece 41 is attracted to the other end portion 14*b* of the iron core 14.

If the voltage application to the magnetic block 10 is stopped, the movable block 40 is rotated in the opposite direction of the above based on the magnetic force of the permanent magnet 42, and the torsion moment of the shaft portions 51 of the hinge portions 50, and returned to the original position.

EXAMPLES

Example

In the electromagnetic relay of the above embodiment, as shown in FIG. 9A, the bottom portion of the second cutout portion 54 of the hinge portion 50 was welded so as to be integrated with the connection receiving portion 30*a* of the common contact terminal 30 to provide a welded portion 59. A spring force acting in the welded portion 59 was analyzed. The analysis results are shown in FIG. 10C. As shown in FIG. 10A, end portions of a boundary between the welded portion 59 and the connection portion 52 are denoted as 59*a*, 59*c*, and the abscissas in FIG. 10C show positions along the boundary.

Comparative Example

As shown in FIG. 9C, of a connection portion 52 of a conventional roughly T-shaped hinge portion 50, the roughly center of its inside edge portion was welded so as to be integrated with the connection receiving portion 30*a* of the common contact terminal 30 to provide a welded portion 59. A spring force acting in this case was analyzed. It is arranged so that Comparative Example has the same spring constant as Example by reducing a length dimension and a thickness dimension of the shaft portion 51 of Comparative Example. The analysis results are shown in FIG. 10C. As shown in FIG. 10B, end portions of a boundary between the welded portion 59 and the connection portions 52 are denoted as 59*a*, 59*b*.

As is apparent from FIG. 10C, of the boundary stresses acting on the peripheries of the welded portions 59, Example (M1) and Comparative Example (M2) were compared using their maximum boundary stresses. Example (M1) was about a half of Comparative Example (M2), so that it was found that the maximum boundary stress of Example was greatly reduced. In particular, it was found that at the boundary end portions (59*a*), where cracks firstly occurred, the stress of Example was reduced to about 25% of the stress of Comparative Example.

This is considered as follows. The position of the bottom portion of the first cutout portion 53 is located deeper than the position of the bottom portion of the second cutout portion 54, and the bottom portion of the second cutout portion is welded so as to be integrated with the connection receiving portion 30*a* of the common contact terminal 30, so that the boundary between the welded portion 59 and the connection portion 52 is long. Therefore, a stress generated in the shaft portion 51 is dispersedly loaded from the point 58 of action to the periphery of the welded portion 59 of the second cutout portion 54.

As a result, according to the present embodiment, it is considered that the mechanical durability at the welded portion 59 is improved by 100 times or more if converted based on the S-N curve.

INDUSTRIAL APPLICABILITY

The present invention may be applied not only to an electromagnetic relay having a movable block provided with a hinge portion having a roughly T-shape in plan view, but also to an electromagnetic relay having a movable block provided with a hinge portion having a roughly L-shape in plan view.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. An electromagnetic relay comprising:

a movable block;

a pair of hinge portions that protrude from both sides of the movable block on a first axis, each of the pair of hinge portions comprising a wide connection portion and a shaft portion;

a base block having common contact terminals disposed thereon; and an electromagnetic block mounted on the base block, wherein the connection portions of the pair of hinge portions are welded so as to be integrated with the common contact terminals of the base block to provide welded portions, wherein, based on excitation and non-excitation of the electromagnetic block, the movable block is rotated, with the shaft portions of the pair of hinge portions as a rotation axis to open and close contacts, wherein, for each of the pair of hinge portions:

the welded portion is provided in an inside edge portion of the connection portion of the hinge portion, a reference line connects a point of action, which is located between the welded portion and the rotation axis, and a center of the welded portion, and the reference line intersects a boundary between the connection portion and the welded portion, which are welded so as to be integrated.

2. An electromagnetic relay comprising:

a movable block;

a pair of hinge portions that protrude from both sides of the movable block on a first axis, each of the pair of hinge portions comprising a wide connection portion and a shaft portion;

a base block having common contact terminals disposed thereon; and an electromagnetic block mounted on the base block, wherein the connection portions of the pair of hinge portions are welded so as to be integrated with the common contact terminals of the base block to provide welded portions, wherein, based on excitation and non-excitation of the electromagnetic block, the movable block is rotated, with the shaft portions of the pair of hinge portions as a rotation axis to open and close contacts, wherein, for each of the pair of hinge portions:

the welded portion is provided in an inside edge portion of the connection portion of the hinge portion, a reference line connects a point of action, which is located between the welded portion and the rotation axis, and a center of the welded portion, the reference line intersects a boundary between the connection portion and the welded portion, which are welded so as to be integrated, and wherein, for each of the pair of the hinge portions, a bottom portion of a cutout portion provided in the inside edge portion of the connection portion of the hinge portion is welded so as to be integrated with the common contact terminal of the base block to provide the welded portion.

3. The electromagnetic relay according to claim 1, wherein each of the pair of hinge portions has a roughly T-shape in plan view.

4. The electromagnetic relay according to claim 2, wherein each of the pair of hinge portions has a roughly T-shape in plan view.

* * * * *